United States Patent [19]

Bandrowski, Jr.

[11] 4,018,195

[45] Apr. 19, 1977

[54] INSULATED, HIGH EFFICIENCY, LOW HEAT REJECTION, ENGINE CYLINDER HEAD

[75] Inventor: Michael Bandrowski, Jr., Milford, Mich.

[73] Assignee: General Motors Corporation, Detroit, Mich.

[22] Filed: Oct. 6, 1975

[21] Appl. No.: 619,797

[52] U.S. Cl. ..... 123/41.76; 123/65 EM; 123/193 H; 60/272

[51] Int. Cl.[2] ..... F01P 3/14; F02F 1/26

[58] Field of Search .... 123/32 AA, 65 EM, 188 M, 123/188 S, 188 GC, 52 M, 52 MC, 41.85, 41.76, 193 H, 193 CH, 191 A, 191 R; 60/272, 282

[56] References Cited

UNITED STATES PATENTS

| | | | |
|---|---|---|---|
| 1,605,838 | 11/1926 | Hawley, Jr. | 123/191 A |
| 1,835,971 | 12/1931 | Schattaner | 123/191 A X |
| 3,081,754 | 3/1963 | Georges | 123/191 A X |
| 3,750,403 | 8/1973 | Deutschmann et al. | 60/272 X |
| 3,865,087 | 2/1975 | Sihon | 123/41.85 X |

FOREIGN PATENTS OR APPLICATIONS

| | | | |
|---|---|---|---|
| 717,984 | 1/1932 | France | 123/191 A |

*Primary Examiner*—C. J. Husar
*Assistant Examiner*—Craig R. Feinberg
*Attorney, Agent, or Firm*—Robert J. Outland

[57] ABSTRACT

A diesel engine cylinder head is provided with air gap inserts for insulating the combustion and exhaust gas exposed surfaces from the coolant jacket exposed walls so as to limit heat transfer to the engine coolant. Various insert elements are disclosed which may be used independently or in combination. Installation of a prefabricated multiple port exhaust insert which permits improved efficiency of gas flow is provided for by utilizing a two-piece construction for the main housing of the cylinder head.

2 Claims, 10 Drawing Figures

INSULATED, HIGH EFFICIENCY, LOW HEAT REJECTION, ENGINE CYLINDER HEAD

FIELD OF THE INVENTION

This invention relates to internal combustion engines and more particularly to cylinder heads for such engines, especially diesel engines, having means to limit heat transfer to the engine coolant and improve gas flow efficiency.

BACKGROUND OF THE INVENTION

It is known in the art relating to internal combustion engines that operating efficiency may be improved and heat loss from the combustion and exhaust gases may be limited by applying insulating coatings or inserts to the working gas exposed surfaces. Nevertheless, while the prior art shows numerous examples of proposals for accomplishing such purposes, these proposals have not, for the most part, evolved into practical commercial constructions. However, the need for such constructions exists in order to obtain higher engine efficiencies, control exhaust emissions and limit the size of external cooling system required for a given engine horsepower output.

SUMMARY OF THE INVENTION

The present invention proposes engine cylinder head constructions involving the application of air gap inserts to cylinder head exhaust passages, exhaust ports and firing face to limit the loss of heat to the engine coolant through the combustion and exhaust gas exposed surfaces, as well as to improve gas flow efficiency. The arrangements provide various specific features of construction which accommodate the designs to practical manufacture and use. These, along with other features and advantages of the invention, will be more apparent from the following description of certain preferred embodiments taken together with the accompanying drawings.

BRIEF DESCRIPTION OF THE DRAWINGS

In the drawings:

FIG. 1 is a top view partially cut away to show certain internal construction features;

FIGS. 2 and 7 are longitudinal cross-sectional views taken in the planes indicated by the lines 2—2 and 7—7, respectively, of FIG. 1;

FIGS. 3, 4 and 5 are transverse cross-sectional views taken in the planes indicated by the lines 3—3, 4—4 and 5—5, respectively, of FIG. 1;

FIG. 6 is a side view from the plane indicated by the line 6—6 of FIG. 1;

FIG. 8 is a pictorial cross-sectional view;

FIG. 9 is a longitudinal cross-sectional view taken in the plane indicated by the line 9—9 of FIG. 10; and FIG. 10 is a bottom view from the plane indicated by the line 10—10 of FIG. 9.

DESCRIPTION OF THE ILLUSTRATED EMBODIMENTS

Figure 1:
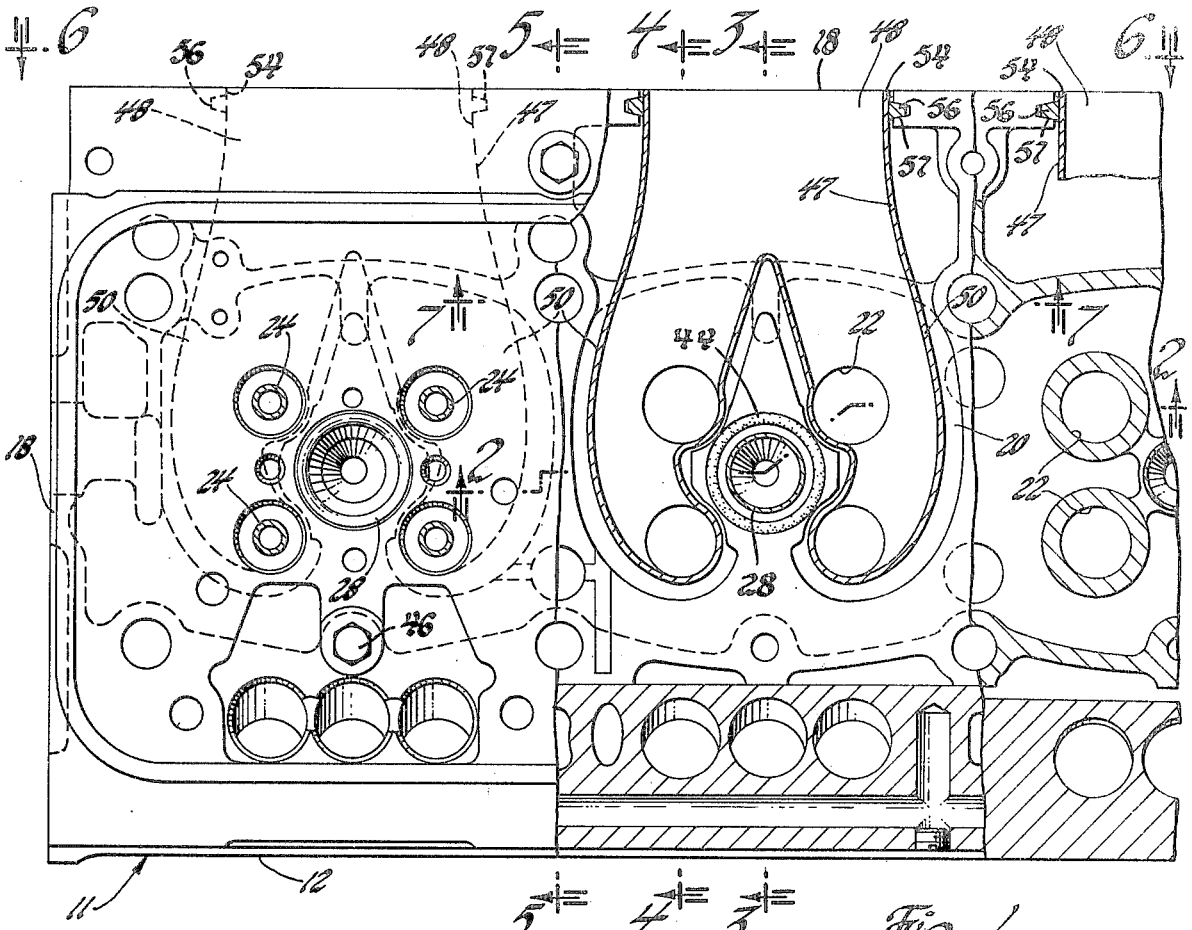
FIGS. 1–7 illustrate one embodiment of cylinder head utilizing a two-piece construction of the main housing with insertion of prefabricated multiple port exhaust passage liners.
Figure 2:
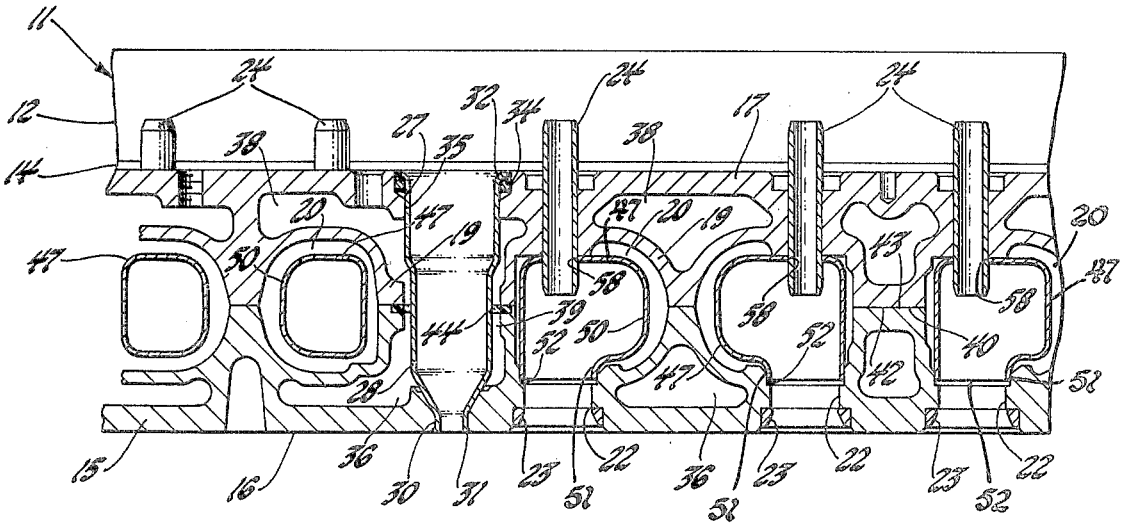
Figure 3:
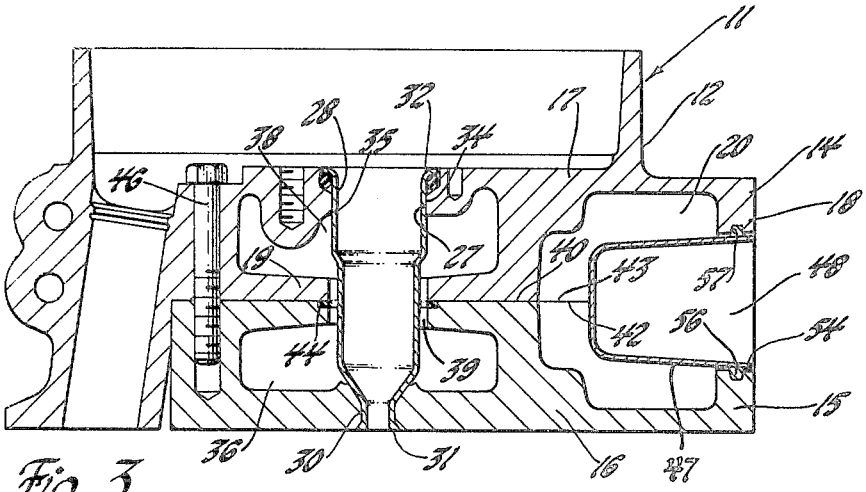
Figure 4:
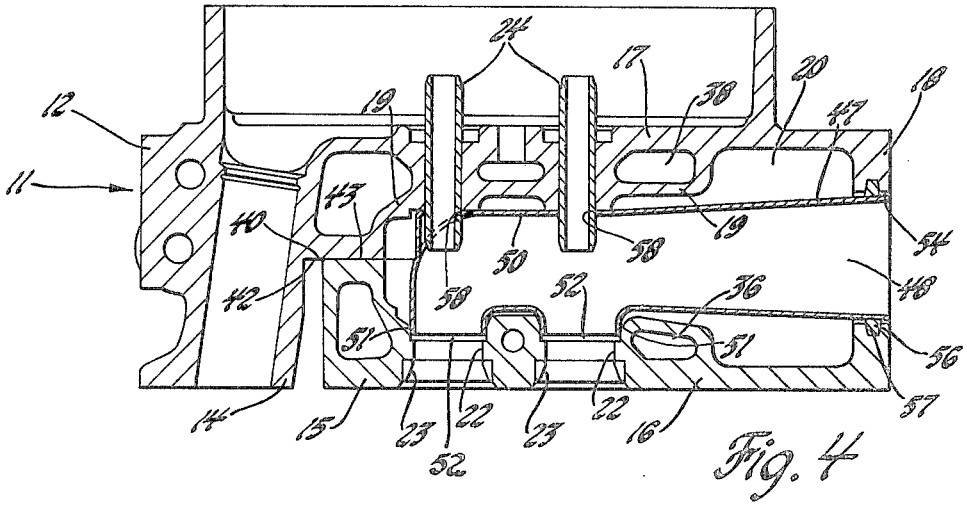
Figure 5:
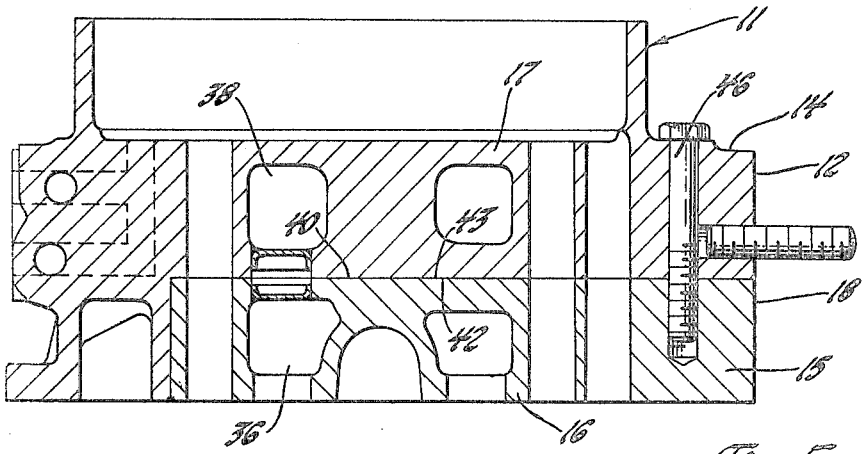
Figure 6:
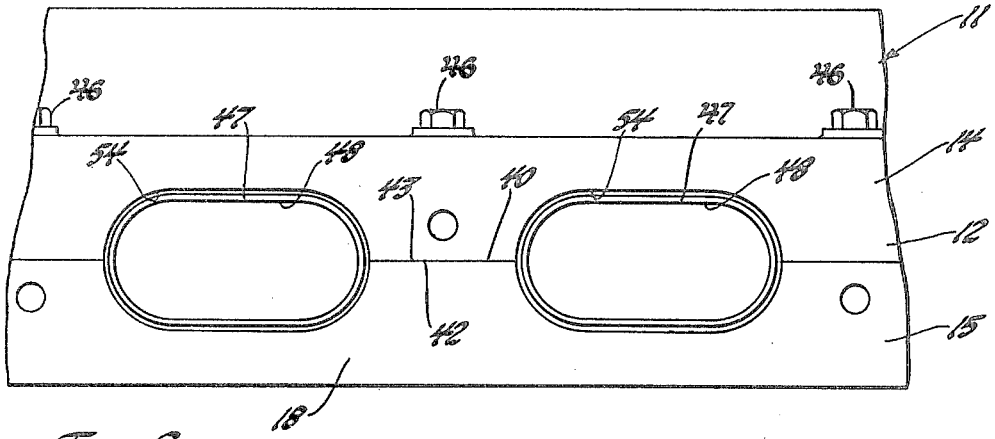
Figure 7:
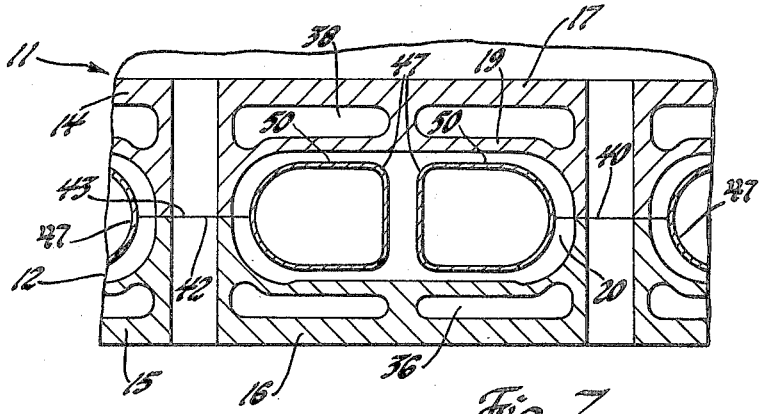

In the drawings, in which like numerals indicate like parts and modified parts are indicated by numerals with appended letters, there are illustrated certain embodiments of cylinder heads for use in internal combustion engines and formed according to the present invention. Although the embodiments illustrated are designed for use with a type of two-cycle uniflow scavenged diesel engine of well known construction, it should be understood that the applications of the invention are not limited to engines of this type.

Numeral 11 generally indicates one embodiment of cylinder head illustrated in FIGS. 1–7. Cylinder head 11 includes a main body or housing 12 formed of two main components, an upper housing member 14 and a lower housing member 15. While the construction of the main housing in two sections or members is advantageous for certain purposes of the invention, as will subsequently be more fully explained, it is not required for all purposes of the invention that the cylinder head be so constructed.

The main body 12 of the cylinder head 11 includes a lower wall or fire deck 16, an upper wall 17 and a peripheral side wall or walls 18 which interconnect peripherally the upper and lower walls. These walls combine with certain interior walls 19 to define internally an exhaust cavity 20 at each cylinder location of the cylinder head. It should be understood that the cylinder head is adapted in use to be mounted upon the block, not shown, of an internal combustion engine with its lower wall or firing face 16 engaging an end wall of the block so as to close the ends of the cylinders therein and partially define combustion chambers at the cylinder ends. At each cylinder location a plurality of exhaust ports 22, in the present instance four for each cylinder location, are disposed in a generally rectangular pattern in the lower wall so as to connect the combustion chamber of the associated cylinder with its respective exhaust cavity 20 within the cylinder head. If desired, the exhaust ports may be provided with valve seat inserts 23. In addition, tubular valve guides 24 are retained in the cylinder head upper wall 18 in alignment with the exhaust ports 22 so as to receive in conventional manner poppet exhaust valves, not shown, reciprocably disposed in the valve guides and adapted to open or close the exhaust ports.

Centrally disposed between the exhaust ports 22 of each cylinder location and preferably located axially of the associated engine cylinder, not shown, the cylinder head body defines a vertical opening 27 in which there is received a component receiving tube or wall in the form of a copper injector tube 28 which, in the present instance, is adapted to receive a fuel injector, not shown. The lower end of the injector tube is necked down to a small diameter 30 where it penetrates the lower wall, and is flared outwardly at 31 into a countersunk area of the cylinder head lower wall, thereby retaining the tube 28 in place in sealing engagement with the lower wall. At its upper end a flanged portion 32 of the injector tube engages an O-ring seal 34 for sealing the upper wall opening 35 against leakage around the tube.

Within the portion of the cylinder head body surrounding the injector tube, exhaust ports and valve guides, the interior and exterior walls of the cylinder head define a lower coolant jacket 36 and an upper coolant jacket 38. Lower jacket 36 extends along the lower wall 16 and surrounds the exhaust ports 22, as well as the lower portion of the injector tube 28, to provide for cooling of these areas with liquid coolant during operation of the associated engine. The upper coolant jacket 38 extends along the upper wall 17, around the valve guides 24 and the upper portion of the injector tube 28 for cooling these portions of the cylinder head construction. The upper and lower jackets 36, 38 are interconnected at each cylinder location only by an annular opening 39, which extends around the intermediate portion of the injector tube 28, providing clearance between it and the interior walls 19 of the cylinder head. If desired, however, additional passages could be provided connecting the upper and lower jackets.

In the two-piece construction of the cylinder head main body or housing illustrated, the upper and lower portions are divided along a horizontal plane 40 that defines opposed engaging surfaces 42, 43 of the upper and lower housing members, respectively. An O-ring seal 44 is preferably provided between the upper and lower housing members, around the annular opening 39 that forms a part of the engine coolant jacket to prevent leakage of coolant through the joint. The remainder of the opposing surfaces 42, 43 may be maintained in metal-to-metal contact without a gasket, if desired, and are preferably so arranged for control of the cylinder head vertical dimensions, since the exhaust cavity 20 enclosed by the engaging surfaces either does not form an active gas passage or it provides only a passage for cooling air, as will be subsequently explained. The upper and lower members making up the main cylinder head housing are removably retained together by bolts 46 or other suitable fastening means.

EXHAUST PASSAGE LINERS

A primary feature of the invention as illustrated in FIGS. 1–7 is the provision of prefabricated exhaust passage liners 47, which are located at each of the cylinder locations. Liners 47 are formed from a high temperature alloy such as stainless steel or the like and may be fabricated from stamped or pressed metal components welded together, by investment casting or by any other suitable means of construction. Since the liners are separately formed, it is possible to provide intricate and accurate passage shapes and smooth internal surfaces which increase the efficiency of gas flow over that which is possible in conventional cast cylinder head exhaust passages.

Each liner 47 is formed with a large outlet portion 48 from which extend in "Y" fashion a pair of legs 50. The legs encircle the injector tube 28 and lead to downwardly protruding port engaging extensions 51. The extensions are preferably closely fitted within bored out enlargements 52 at the upper ends of the respective exhaust ports 22 so that no seals are required at these locations. The outlet portion of the passage liner extends through an exhaust opening 54 provided in the side wall 18 of the cylinder head and formed partially in each of the upper and lower portions. The opening is preferably sealed by a high temperature material 56 such as asbestos or the like retained in a suitable groove 57. Suitable openings 58 are also provided in the upper portions of the contoured passage liners through which the valve guides 24 extend.

As shown in the drawings, the exhaust cavity 20, within which the exhaust liners are disposed, is shaped so that the liner walls are spaced from the cavity walls and from the internal cylinder head walls that define the coolant jacket, except at certain portions where necessary to seal and support the liners within the head. These contacting portions include the end of the outlet portion 48, the port extension ends 51 and the portions of the upper wall adjacent the valve guide openings 58. In the other locations, the clearance between the liners 47 and the other walls of the cylinder head provides an insulating space which limits the transfer of heat from the exhaust gases passing through the liners to the coolant jackets in the upper and lower portions of the cylinder head and around the injector tube. In this way, loss of heat from the exhaust gases in the cylinder head is controlled, yielding potential efficiency improvements, especially in turbocharged engines, as well as possible gains in exhaust emission control. In addition, the reduced rejection of heat to the engine coolant permits the use of lower cooling fan speeds and/or a smaller external cooling system than would be needed for a conventional engine of comparable power.

Figure 8:
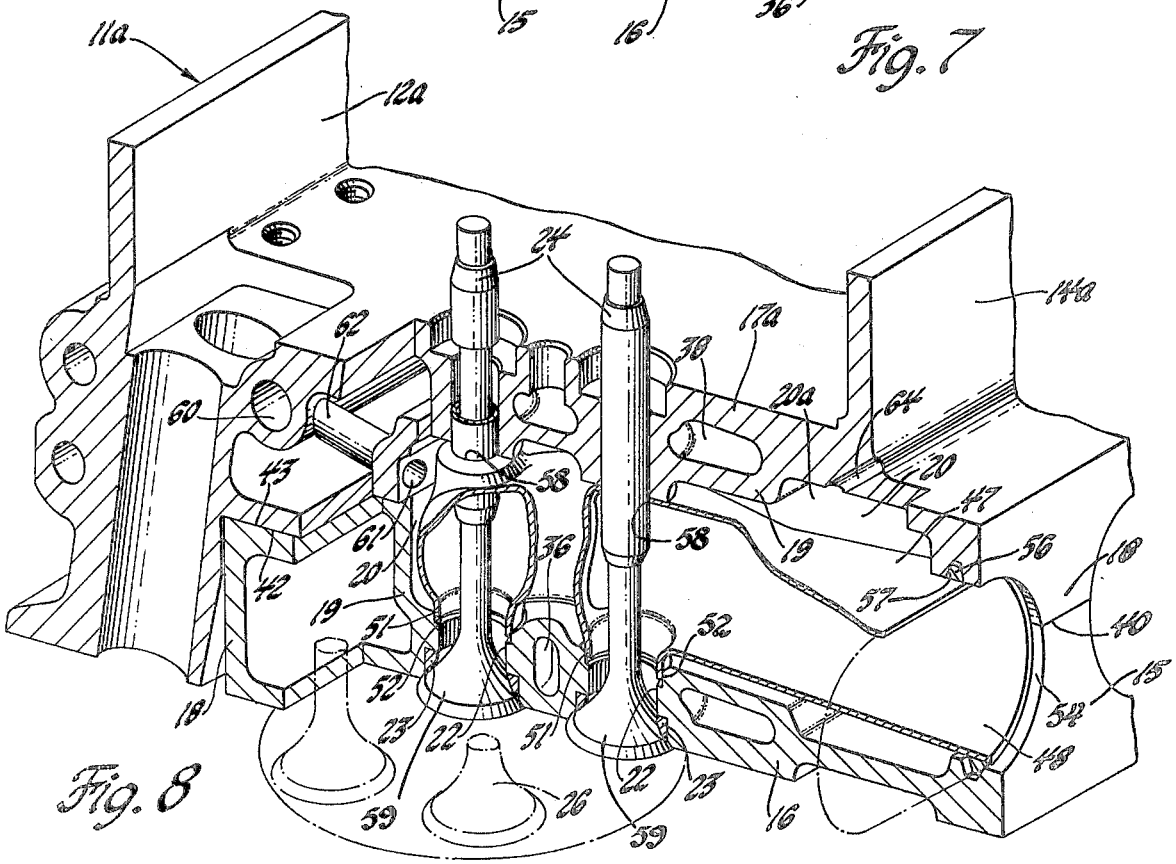
FIG. 8 shows a modification of the first embodiment including provision for air cooling of the exhaust liner air gap volume.

FIG. 8 illustrates an arrangement similar to that of FIGS. 1–7 but shown in a cutaway pictorial view with poppet exhaust valves 59 shown in the assembly. This arrangement includes a further modification in that a longitudinal air gallery 60 is provided in the upper wall **17*a* of the upper housing member 14*a*. Gallery 60 is connected with the exhaust cavity 20 through lateral passages 61 extending through ducts 62. With this construction a small amount of cooling air may be supplied to the air gallery from external means, such as a turbocompressor, and in turn distributed to the exhaust cavity 20 for providing limited cooling in the insulating spaces. This cooling air could be dispersed by leakage through the various joints between the exhaust liners and the cylinder head walls or, if desired, suitable vent openings 64** may be provided for exhaust of the cooling air, preferably to the turbocharger or another part of the engine exhaust system.

Valve Seat and Port Inserts

Figure 9:
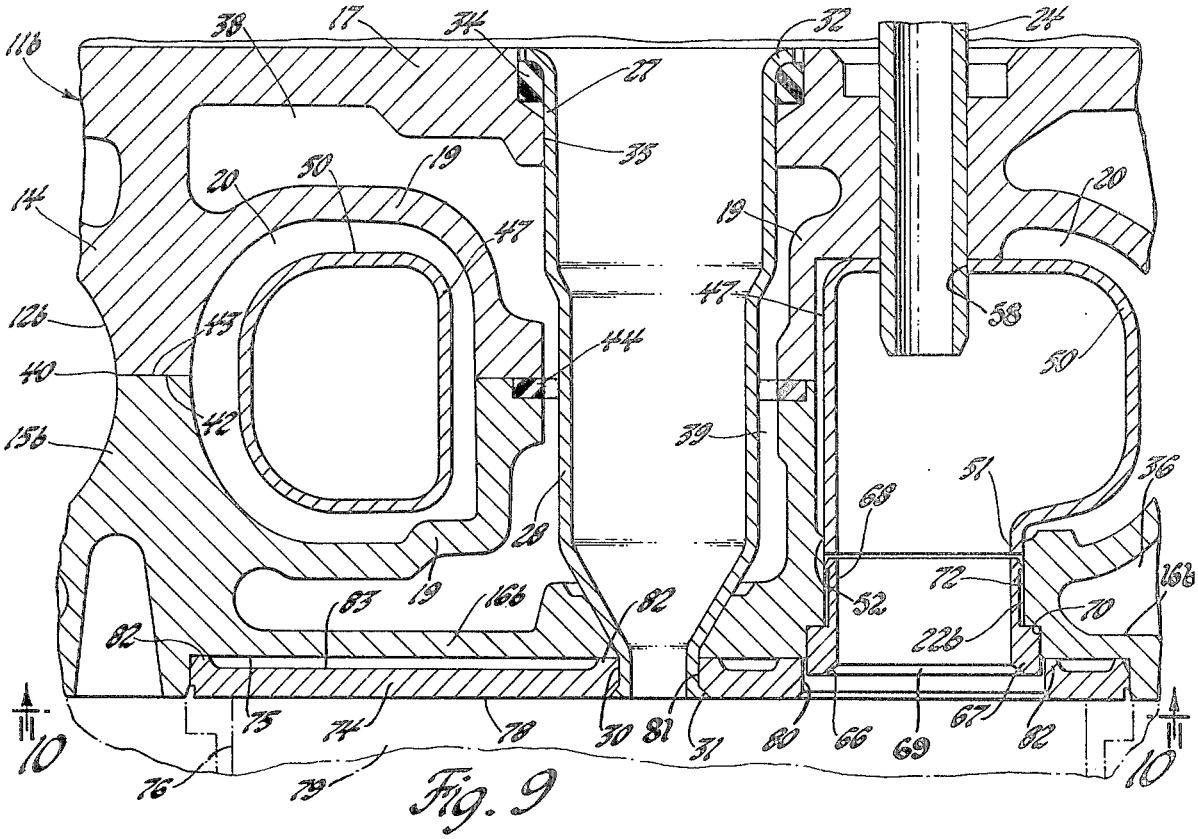
FIGS. 9 and 10 disclose an alternative embodiment which includes, in addition to the features of the embodiment of FIGS. 1–7, the use of air gap valve seat and port inserts and an air gap fire deck insert.
Figure 10:
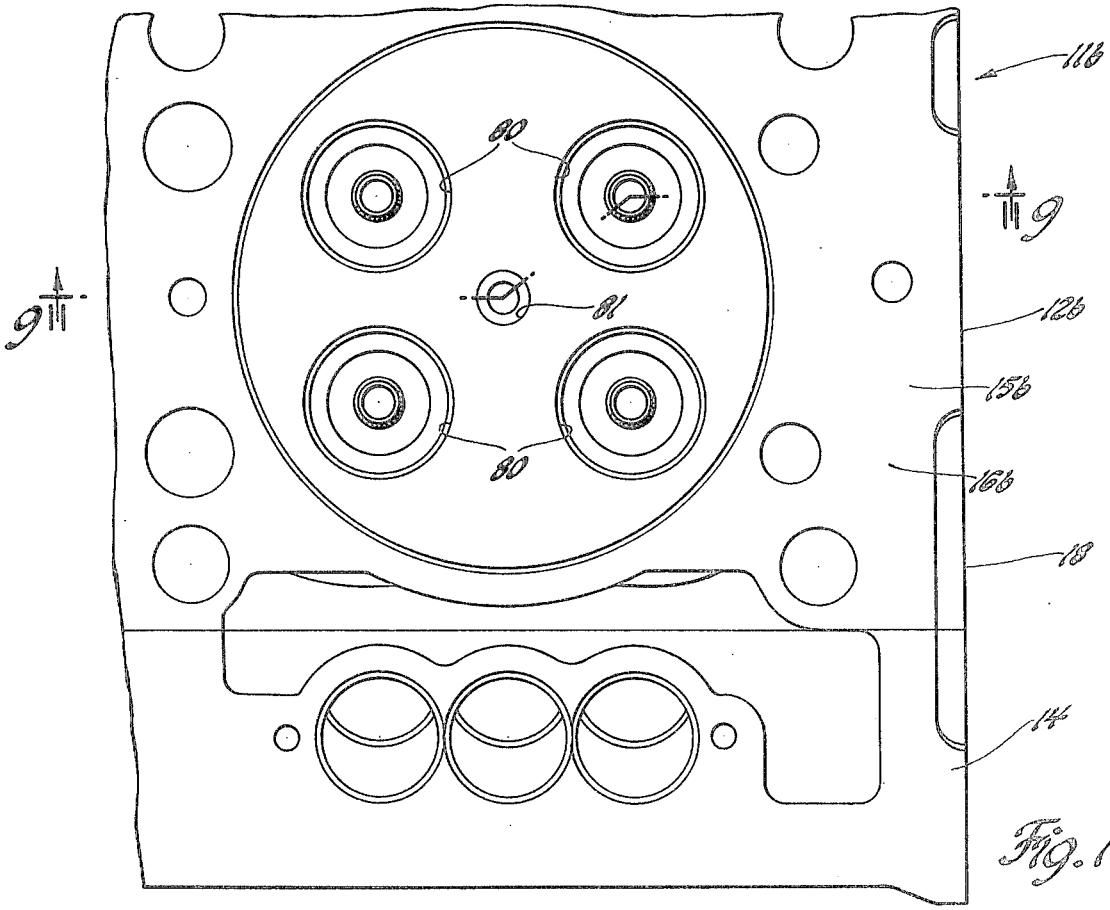

FIGS. 9 and 10 illustrate an alternative embodiment of cylinder head construction according to the invention. In general, the alternative embodiment of FIGS. 9 and 10 has a construction identical to that of the first described embodiment of FIGS. 1–7 with respect to the inclusion of exhaust passage liners 47. However, certain additional features are also included.

One additional feature of the alternative embodiment is the provision of air gap insulated exhaust valve seat and port inserts 66 in modified exhaust port openings **22*b*. With this arrangement, the exhaust ports 22*b* are bored out to receive the inserts which include an enlarged annular ring portion 67 and a smaller diameter tubular extension 68. The annular ring portion 67 defines a valve seat 69 and is received in conventional fashion in a recess 70 on the bottom of the lower wall 16*b*. The ring may be arranged to end flush with the face of the lower wall, as would be usual in a conventional construction; but in the present instance, for reasons which will subsequently be made apparent, the ring portion 67** extends slightly below the wall surface surrounding its respective exhaust port.

The tubular extension 68 of the insert extends upwardly in the exhaust port to a point closely approaching the associated port extension 51 of the respective port liner 47. As a feature of the design, the outer diameter of the tubular extension is reduced at 72, intermediate the annular ring portion 67 and the other end of the extension 68 to provide an air gap or insulating space that limits the flow of exhaust heat from the exhaust port area to the adjacent lower coolant jacket 36.

Fire Deck Inserts

An additional feature of the construction illustrated in FIGS. 9 and 10 is the provision of a fire deck insert 74 to limit heat loss from the combustion chamber of an associated engine. For this feature, the lower wall 16*b* of the cylinder head is provided with a recess 75 which is preferably circular and, in any event, has a minimum outer dimension, in this case the diameter, which is no less than the diameter of the associated engine cylinder liner 76 indicated in phantom lines.

Insert 74 comprises a disc-like member, having a flat lower surface 78 that sealingly engages the end of the cylinder liner 76 so as to form the upper wall of an associated combustion chamber 79. Openings 80 are provided in the disc at each of the exhaust ports to permit the passage of exhaust gases from the combustion chambers. When exhaust port inserts 66 are utilized with this construction as shown, the inserts extend downwardly into the openings 80 part way toward the flat lower surface 78 so that the exhaust valves will clear the lower surface of the fire deck insert promptly after opening, but the edges of the valve seat and port inserts are partially protected from the combustion chamber gases, except when the valves are open.

The fire deck insert is also provided with a central opening 81 which receives the lower end 30 of the injector tube 28. The tube end is flared into a countersunk portion at 31 which retains the insert 74 in position on the cylinder head face. Around each of the openings and at its outer edge, the back of the insert 74 has raised portions 82 which contact the bottom of the cylinder recess 75 and positively locate the outer surface 78 of the insert with respect to the main body of the cylinder head. However, intermediate these raised portions 82 the insert 74 is cut away, as at 83, to form an insulating space or air gap between the insert 74 and the recessed portion of the lower wall 16*b*. This air gap limits the transmission of heat from the combustion chamber to the lower wall and thus to the lower coolant jacket of the cylinder head, thereby increasing the wall temperature of that portion of the combustion chamber wall formed by the fire deck insert and raising engine efficiency accordingly.

It should be apparent that, if desired, the raised portions 82 of the fire deck insert could be eliminated by providing similar raised areas in the machining of the lower wall recess 75 in which case the fire deck insert could be made in the form of a flat plate. Obviously, other suitable shapes might also be utilized.

As is apparent from the foregoing description, the present invention involves the provision of three differing types of inserts in an internal combustion engine cylinder head, any one of which may be used independently of the others or in combination with any or all of the others. Thus, cylinder heads according to the present invention may utilize exhaust passage inserts alone, as illustrated in the embodiments of FIGS. 1–7. Alternatively, exhaust port inserts as illustrated in FIGS. 9 and 10 may be used without association with a fire deck insert, also illustrated in the same figures, or the fire deck insert may be used separately. Obviously, however, the greatest reduction in heat transfer to the engine coolant, and therefore the greatest advantage, should be obtained through the use of all three types of inserts in a single cylinder head construction, as is illustrated in the last described embodiment. Numerous variations of these features, including but not limited to the use of air cooling in the exhaust cavity as illustrated in FIG. 8, may be utilized without departing from the inventive concepts disclosed. Accordingly, it is intended that the invention not be limited, except by the language of the following claims.

I claim:

1. A cylinder head for an internal combustion engine having a lower wall, an upper wall spaced from the lower wall and a side wall interconnecting the upper and lower walls, said lower wall having an outer surface containing a recess adapted for mounting opposite the end of an associated engine cylinder with said recess extending laterally across and beyond the inner diameter of such cylinder, an exhaust cavity within said head and extending through an opening in said side wall, a plurality of spaced exhaust ports through the recessed portion of said lower wall and connecting with said exhaust cavity, a component receiving tubular wall retained in said upper wall and extending through the recessed portion of said lower wall between said exhaust ports, means defining a coolant jacket in said head along said lower wall and around said exhaust ports and component receiving wall, a high temperature metal alloy plate received in and substantially filling said lower wall recess, said plate providing an outer surface engageable with and adapted to close the end of such associated cylinder and having openings in alignment with said exhaust ports and said component receiving wall, said plate including an inner surface in opposed relation to the recessed outer surface of said head lower wall and spacer means along the peripheries of said plate and said plate openings and separating the remainder of said opposing surfaces to provide clearance between said plate and said head over a major portion of said plate inner surface and enclose an insulating air space that limits the flow of heat from such engine cylinder to the cylinder head coolant jacket.

2. The cylinder head of claim 1 wherein said component receiving wall comprises a deformable metal tube having a portion extending through its respective opening in said metal plate, said respective plate opening being enlarged on its outer side and said tube portion being deformed into said enlarged opening portion to sealingly interlock said tube and plate and thereby retain said plate in assembly with said cylinder head.

* * * * *